US010781682B2

(12) United States Patent
Al-Rubaii et al.

(10) Patent No.: US 10,781,682 B2
(45) Date of Patent: Sep. 22, 2020

(54) SYSTEMS AND METHODS FOR OPTIMIZING RATE OF PENETRATION IN DRILLING OPERATIONS

(71) Applicant: Saudi Arabian Oil Company, Dhahran (SA)

(72) Inventors: Mohammed Murif Al-Rubaii, Abha (SA); Ossama R. Sehsah, Rakka (SA); Eno Itam Omini, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 70 days.

(21) Appl. No.: 15/954,758

(22) Filed: Apr. 17, 2018

(65) Prior Publication Data

US 2019/0316457 A1 Oct. 17, 2019

(51) Int. Cl.

| | |
|---|---|
| ***E21B 44/06*** | (2006.01) |
| ***E21B 45/00*** | (2006.01) |
| ***E21B 21/08*** | (2006.01) |
| ***E21B 49/00*** | (2006.01) |
| ***E21B 47/09*** | (2012.01) |
| ***E21B 3/04*** | (2006.01) |

(52) U.S. Cl.

CPC ..... *E21B 44/06* (2013.01); *E21B 3/04* (2013.01); *E21B 21/08* (2013.01); *E21B 45/00* (2013.01); *E21B 47/09* (2013.01); *E21B 49/005* (2013.01)

(58) Field of Classification Search

CPC ..... E21B 44/06; E21B 22/08

See application file for complete search history.

(56) References Cited

U.S. PATENT DOCUMENTS

| | | | |
|---|---|---|---|
| 4,473,124 | A | 9/1984 | Savins |
| 6,475,959 | B1 | 11/2002 | Lange et al. |
| 8,099,266 | B2 | 1/2012 | Burge et al. |
| 8,892,407 | B2 | 11/2014 | Budiman et al. |
| 8,965,703 | B2 | 2/2015 | Prakash et al. |
| 9,175,557 | B2 | 11/2015 | Iversen et al. |
| 9,567,836 | B2 | 2/2017 | Jamison et al. |
| 2007/0185696 | A1 | 8/2007 | Moran et al. |

(Continued)

FOREIGN PATENT DOCUMENTS

WO 2017027105 A1 2/2017

OTHER PUBLICATIONS

Hopkin, E.A.; "Factors Affecting Cuttings Removal During Rotary Drilling" SPE-1697-PA, Journal of Petroleum Technology, Jun. 1967; pp. 807-814.

(Continued)

*Primary Examiner* — Kristyn A Hall
*Assistant Examiner* — Dany E Akakpo
(74) *Attorney, Agent, or Firm* — Bracewell LLP; Constance G. Rhebergen; Vivek P. Shankam

(57) ABSTRACT

Systems and methods for predicting an efficient hole cleaning in vertical, deviated, and horizontal holes by developing a hole cleaning model that combines hole cleaning and drilling rate to optimize performance. Specifically by ensuring optimum mud rheology values that have an influence on drilling mud from the aspects of ECD, cuttings transport, shear thinning, and thixotropic, and developing an effective hole cleaning model by utilizing carrying capacity index (CCI) and cutting concentration in annulus (CCA).

24 Claims, 12 Drawing Sheets

(56) References Cited

U.S. PATENT DOCUMENTS

| | | | | |
|---|---|---|---|---|
| 2013/0192360 | A1* | 8/2013 | Jamison | E21B 21/00 73/152.19 |
| 2015/0129306 | A1 | 5/2015 | Coffman et al. | |
| 2016/0252897 | A1 | 9/2016 | Ashok et al. | |
| 2017/0044896 | A1 | 2/2017 | Salminen | |
| 2017/0067337 | A1 | 3/2017 | Havens et al. | |
| 2017/0081580 | A1 | 3/2017 | Maghrabi et al. | |

OTHER PUBLICATIONS

Mohammadsalehi, M. et al.; "Application of New Hole Cleaning Optimization Method within All Ranges of Hole Inclinations" IPTC 14154, International Petroleum Technology Conference Bangkok, Thailand Feb. 7-9, 2012; pp. 1-8.

Newitt, D.M. et al.; "Hydraulic Conveying of Solids in Vertical Pipes" Trans. Instn. Chem. Engrs, vol. 39, 1961; pp. 93-100.

Sifferman, T.R. et al.; "Hole Cleaning in Full-Scale Inclined Wellbores" SPE-20422-PA, SPE Drilling Engineering, Jun. 1992; pp. 115-120.

International Search Report and Written Opinion for International Application No. PCT/US2019/027739 report dated Jul. 22, 2019; pp. 1-15.

Irawan, S. et al., "Maximizing Drilling Performance through Enhanced Solid Control System", IOP Conference Series: Materials Science and Engineering 267 (2017) pp. 1-14.

Sui, Dan et al.,"Rate of Penetration Optimization using Moving Horizon Estimation", Modeling Identification and Control, vol. 37, No. 3, 2016; pp. 149-158.

* cited by examiner

600

| Model Optimization prospect | Success | Percentage % |
|---|---|---|
| ROP | Improvement | 72 |
| DSE | Minimizing | 64 |
| HHPb | Improvement | 32 |
| CCI | Improvement | 58 |
| Vann | Improvement | 12 |
| YP/PV | Improvement | 42 |

| Model Optimization prospect | Max | Min |
|---|---|---|
| ROP (ft/hr) | 168 | 21 |
| Optimized ROP (ft/hr) | 276 | 138 |
| DSE (Psi) | 390595 | 7444 |
| Optimized DSE (Psi) | 78897 | 103 |
| HHPb (HP) | 833 | 49 |
| Optimized HHPb (HP) | 1133 | 85 |
| CCI | 7 | 1 |
| Optimized CCI | 12 | 8 |
| Vann (Ft/min) | 110 | 90 |
| Optimized Vann (Ft/min) | 127 | 127 |
| YP/PV | 3 | 1 |
| Optimized YP/PV | 3 | 3 |
| K | 1950 | 406 |
| Optimized K | 2740 | |
| n | 0.6 | 0.45 |
| Optimized n | 0.3 | |
| PV/YP | 1.5 | 0.58 |
| Optimized PV/YP | 0.3 | |

FIG. 6

700

Model Trials in two wells

| Model Optimization prospect | Success | Percentage % |
|---|---|---|
| ROP | Improvement | 60 |
| DSE | Minimizing | 50 |
| HHPb | Improvement | 50 |
| CCI | Improvement | 60 |
| Vann | Improvement | 50 |
| YP/PV | Improvement | 50 |

| Model Optimization prospect | Well-A | Well-B |
|---|---|---|
| avg ROP (ft/hr) | 30.32 | 34.36 |
| Optimized avg ROP (ft/hr) | 75.35 | 77.49 |
| DSE (Psi) | 244039 | 230493 |
| Optimized DSE (Psi) | 139590 | 105806 |
| HHPb (HP) | 150 | 189 |
| Optimized HHPb (HP) | 315 | 387 |
| CCI | 3 | 4 |
| Optimized CCI | 8 | 10 |
| Vann (Ft/min) | 181 | 155 |
| Optimized Vann (Ft/min) | 302 | 324 |
| YP/PV | 1.47 | 1.6 |
| Optimized YP/PV | 3 | 3 |
| K | 1008 | 1066 |
| Optimized K | 2740 | 2740 |
| n | 0.5 | 0.47 |
| Optimized n | 0.3 | 0.3 |
| PV/YP | 0.68 | 0.63 |
| Optimized PV/YP | 0.3 | 0.3 |

FIG. 7

SYSTEMS AND METHODS FOR OPTIMIZING RATE OF PENETRATION IN DRILLING OPERATIONS

BACKGROUND

1. Field

This disclosure relates generally to the field of construction of wellbores through subsurface formations. More particularly the disclosure relates to methods for automatically calculating and displaying to drilling operations personnel values of drilling operating parameters that may optimize drilling of such wellbores and to characterize drilling performance on a specific wellbore with respect to benchmarks for such performance.

2. Description of Related Art

Background

Drilling wellbores through subsurface formations includes suspending a "string" of drill pipe ("drill string") from a drilling unit or similar lifting apparatus and operating a set of drilling tools and rotating a drill bit disposed at the bottom end of the drill string. The drill bit may be rotated by rotating the entire drill string from the surface and/or by operating a motor disposed in the set of drilling tools. The motor may be, for example, operated by the flow of drilling fluid ("mud") through an interior passage in the drill string. The mud leaves the drill string through the drill bit and returns to the surface through an annular space between the drilled wellbore wall and the exterior of the drill string. The returning mud cools and lubricates the drill bit, lifts drill cuttings to the surface and provides hydrostatic pressure to mechanically stabilize the wellbore and prevent fluid under pressure from entering the wellbore from certain permeable formations exposed to the wellbore. The mud may also include materials to create an impermeable barrier ("filter cake") on exposed formations having a lower fluid pressure than the hydrostatic pressure of the mud in the annular space so that mud will not flow into such formations in any substantial amount.

The drilling unit may have controls for selecting "drilling operating parameters." In the present context, the term drilling operating parameters means those parameters which are controllable by the drilling unit operator and/or associated personnel and include, as non-limiting examples, axial force (weight) of the drill string suspended by the drilling unit as applied to the drill bit, rotational speed of the drill bit ("RPM"), the rate at which drilling fluid is pumped into the drill string, and the rotational orientation or tool face ("TF") of the drill string when certain types of motors are used to rotate the drill bit. As a result of the particular values of drilling operating parameters such as the foregoing, the results may include that wellbore will be drilled (lengthened) at a particular rate and along a trajectory (well path) and may result in a particular measured pressure of the drilling fluid at the point of entry into the drill string or proximate thereto, called standpipe pressure ("SPP"). The foregoing are non-limiting examples of "drilling response parameters."

Stuck pipe while drilling can be a common problem in the oil industry. In fact, stuck pipe has become a more significant source of non-productive time because extended reach horizontal drilling has gained use in unconventional shale plays. Unfortunately, stuck pipe is often difficult to detect until after the sticking event has already occurred.

Typically, drilling jars, which are intended to create a hammer effect on the drill string, are run to provide a way to "un-stick" the drill string. Yet, extended reach horizontal drilling has changed traditional thinking because it reduces the effectiveness of jars by limiting force transfer from the vertical section to the horizontal section of the well. For this reason, many operators have stopped running drilling jars in these types of wells. Consequently, operators have very few ways to detect/prevent stuck pipe so that in some sense nothing can be done to address the issue if it occurs.

Other than using drilling jars, many operators mandate pumping high viscosity "sweeps" at some regular interval while drilling. A typical frequency involves one sweep for every three stands of pipe drilled. The "sweeps" are meant to clean the borehole near the bit and reduce the changes of sticking.

Operators also rely on the expertise of rig site supervisors to be able to detect when the well is being drilled "too fast" and/or if any of the telltale signs of impending stuck pipe are being observed at the surface. Operators may also supplement these efforts by having a remote tactical operations center (RTOC) monitor drilling operations remotely.

Historically, raw real-time data may be plotted during drilling. To determine an appropriate rate of penetration, operators rely on human interpretation of whether the pump pressure, torque, hook load, and other parameters fall outside of the "normal" or "acceptable" ranges. Changes to rate of penetration (ROP) in what is sometimes called "controlled drilling" can be made based on human judgment. For example, limits can be placed on ROP based on experience in the area (i.e. operators may merely know how fast drilling was proceeding when the last problem occurred). Additionally, limits can be placed on ROP based on the ability of surface equipment to simply clean out solids from the mud coming through the flow line.

As will be appreciated, the above methods are highly subjective and may be unreliable. In many instance, a drilling regime used at one well is simply just copied to the next well without regard to changes in geology, drilling conditions, etc. In short, current techniques to mitigate stuck pipe during drilling are insufficient.

What is needed is a real-time system to proactively calculate a desired rate-of-penetration (ROP) during a drilling operation to mitigate issues with stuck pipe. The subject matter of the present disclosure is directed to overcoming, or at least reducing the effects of, one or more of the problems set forth above.

SUMMARY

Systems and methods for providing efficient hole cleaning in vertical, deviated and horizontal holes by developing an effective hole cleaning model by utilizing carrying capacity index (CCI) and cutting concentration in annulus (CCA), and integrating the hole cleaning model that links hole cleaning and drilling rate by using drilling specific energy (DSE) to optimize performance are disclosed. More specifically, the systems and methods ensure optimum mud rheology values that have effective influence on drilling mud from the aspects of equivalent circulating density (ECD), cuttings transport, shear thinning, and thixotropic properties.

One example embodiment is a method of drilling a borehole with a drill tool of a drilling system that uses drilling mud to transport cuttings of a formation to surface. The method includes receiving a plurality of input parameters of a drilling operation conducted with the drilling system, the input parameters at least including a cuttings parameter related to the cuttings produced in the drilling operation, determining a current concentration of the cuttings in the drilling operation at least near the drill tool based on the obtained parameters, determining a desired rate of penetration for the drilling operation based on the determined concentration, and altering a current rate of penetration based on the determined rate.

Another example embodiment is a program storage device having program instructions stored thereon for causing a programmable control device to perform a method of drilling a borehole according to the above method.

Another example embodiment is a drilling system for drilling a borehole with a drill tool using drilling mud to transport cuttings of a formation to surface. The system includes storage storing historical information, an interface obtaining a plurality of parameters of a drilling operation conducted with the drilling system, the input parameters at least including a cuttings parameter related to the cuttings produced in the drilling operation, and a processing unit in communication with the storage and the interface and configured to receive a plurality of input parameters of a drilling operation conducted with the drilling system, the input parameters at least including a cuttings parameter related to the cuttings produced in the drilling operation, determine a current concentration of the cuttings in the drilling operation at least near the drill tool based on the obtained parameters, determine a desired rate of penetration for the drilling operation based on the determined concentration, and alter a current rate of penetration based on the determined rate.

BRIEF DESCRIPTION OF DRAWINGS

The foregoing aspects, features, and advantages of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. Like reference numerals refer to like elements throughout the specification.

FIG. 6 is a table showing test results obtained using a method for optimizing rate of penetration in a drilling operation, according to one or more example embodiments.

FIG. 7 is a table showing test results obtained via model trials performed in two wells using a method for optimizing rate of penetration in a drilling operation, according to one or more example embodiments.

DETAILED DESCRIPTION

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art.

Figure 1:
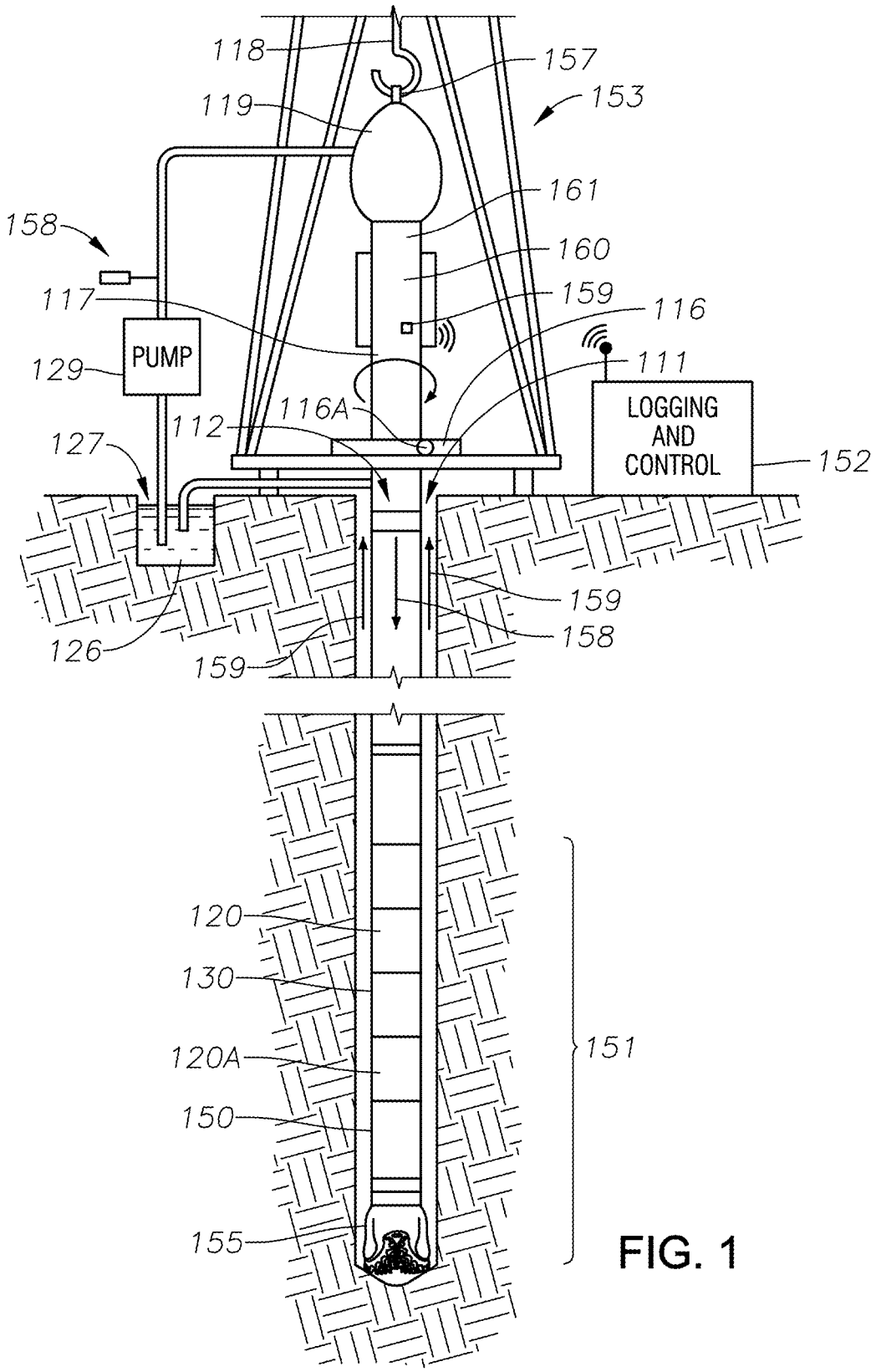
FIG. 1 is a schematic of a drilling and measurement system including a bottom hole assembly and a logging and control system, according to one or more example embodiments.

FIG. 1 shows a simplified view of an example drilling and measurement system that may be used in some embodiments. The drilling and measurement system shown in FIG. 1 may be deployed for drilling either onshore or offshore wellbores. In a drilling and measurement system as shown in FIG. 1, a wellbore 111 may be formed in subsurface formations by rotary drilling in a manner that is well known to those skilled in the art. Although the wellbore 111 in FIG. 1 is shown as being drilled substantially straight and vertically, some embodiments may be directionally drilled, i.e. along a selected trajectory in the subsurface.

A drill string 112 is suspended within the wellbore 111 and has a bottom hole assembly (BHA) 151 which includes a drill bit 155 at its lower (distal) end. The surface portion of the drilling and measurement system includes a platform and derrick assembly 153 positioned over the wellbore 111. The platform and derrick assembly 153 may include a rotary table 116, kelly 117, hook 118 and rotary swivel 119 to suspend, axially move and rotate the drill string 112. In a drilling operation, the drill string 112 may be rotated by the rotary table 116 (energized by means not shown), which engages the kelly 117 at the upper end of the drill string 112. Rotational speed of the rotary table 116 and corresponding rotational speed of the drill string 112 may be measured un a rotational speed sensor 116A, which may be in signal communication with a computer in a surface logging, recording and control system 152 (explained further below). The drill string 112 may be suspended in the wellbore 111 from a hook 118, attached to a traveling block (also not shown), through the kelly 117 and a rotary swivel 119 which permits rotation of the drill string 112 relative to the hook 118 when the rotary table 116 is operates. As is well known, a top drive system (not shown) may be used in other embodiments instead of the rotary table 116, kelly 117 and swivel rotary 119.

Drilling fluid ("mud") 126 may be stored in a tank or pit 127 disposed at the well site. A pump 129 moves the drilling fluid 126 to from the tank or pit 127 under pressure to the interior of the drill string 112 via a port in the swivel 119, which causes the drilling fluid 126 to flow downwardly through the drill string 112, as indicated by the directional arrow 158. The drilling fluid 126 travels through the interior of the drill string 112 and exits the drill string 112 via ports in the drill bit 155, and then circulates upwardly through the annulus region between the outside of the drill string 112 and the wall of the borehole, as indicated by the directional arrows 159. In this known manner, the drilling fluid lubricates the drill bit 155 and carries formation cuttings created by the drill bit 155 up to the surface as the drilling fluid 126 is returned to the pit 127 for cleaning and recirculation. Pressure of the drilling fluid as it leaves the pump 129 may be measured by a pressure sensor 158 in pressure communication with the discharge side of the pump 129 (at any position along the connection between the pump 129 discharge and the upper end of the drill string 112). The pressure sensor 158 may be in signal communication with a computer forming part of the surface logging, recording and control system 152, to be explained further below.

The drill string 112 typically includes a BHA 151 proximate its distal end. In the present example embodiment, the BHA 151 is shown as having a measurement while drilling (MWD) module 130 and one or more logging while drilling (LWD) modules 120 (with reference number 120A depicting a second LWD module 120). As used herein, the term "module" as applied to MWD and LWD devices is understood to mean either a single instrument or a suite of multiple instruments contained in a single modular device. In some embodiments, the BHA 151 may include a "steerable" hydraulically operated drilling motor of types well known in the art, shown at 150, and the drill bit 155 at the distal end.

The LWD modules 120 may be housed in one or more drill collars and may include one or more types of well logging instruments. The LWD modules 120 may include capabilities for measuring, processing, and storing information, as well as for communicating with the surface equipment. By way of example, the LWD module 120 may include, without limitation one of a nuclear magnetic resonance (NMR) well logging tool, a nuclear well logging tool, a resistivity well logging tool, an acoustic well logging tool, or a dielectric well logging tool, and so forth, and may include capabilities for measuring, processing, and storing information, and for communicating with surface equipment, e.g., the surface logging, recording and control unit 152.

The MWD module 130 may also be housed in a drill collar, and may contain one or more devices for measuring characteristics of the drill string 112 and drill bit 155. In the present embodiment, the MWD module 130 may include one or more of the following types of measuring devices: a weight-on-bit (axial load) sensor, a torque sensor, a vibration sensor, a shock sensor, a stick/slip sensor, a direction measuring device, and an inclination and geomagnetic or geodetic direction sensor set (the latter sometimes being referred to collectively as a "D&I package"). The MWD module 130 may further include an apparatus (not shown) for generating electrical power for the downhole system. For example, electrical power generated by the MWD module 130 may be used to supply power to the MWD module 130 and the LWD module(s) 120. In some embodiments, the foregoing apparatus (not shown) may include a turbine-operated generator or alternator powered by the flow of the drilling fluid 126. It is understood, however, that other electrical power and/or battery systems may be used to supply power to the MWD and/or LWD modules.

In the present example embodiment, the drilling and measurement system may include a torque sensor 159 proximate the surface. The torque sensor 159 may be implemented, for example in a sub 160 disposed proximate the top of the drill string 112, and may communicate wirelessly to a computer in the surface logging, recording and control system 152, explained further below. In other embodiments, the torque sensor 159 may be implemented as a current sensor coupled to an electric motor (not shown) used to drive the rotary table 116. In the present example embodiment, an axial load (weight) on the hook 118 may be measured by a hookload sensor 157, which may be implemented, for example, as a strain gauge. The sub 160 may also include a hook elevation sensor 161 for determining the elevation of the hook 118 at any moment in time. The hook elevation sensor 161 may be implemented, for example as an acoustic or laser distance measuring sensor. Measurements of hook elevation with respect to time may be used to determine a rate of axial movement of the drill string 112. The hook elevation sensor may also be implemented as a rotary encoder coupled to a winch drum used to extend and retract a drill line used to raise and lower the hook (not shown in the Figure for clarity). Uses of such rate of movement, rotational speed of the rotary table 116 (or, correspondingly the drill string 112), torque and axial loading (weight) made at the surface and/or in the MWD module 130 may be used in one more computers as will be explained further below.

The operation of the MWD and LWD instruments of FIG. 1 may be controlled by, and sensor measurements from the various sensors in the MWD and LWD modules and the other sensors disposed on the drilling and measurement unit described above may be recorded and analyzed using the surface logging, recording and control system 152. The surface logging, recording and control system 152 may include one or more processor-based computing systems or computers. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for processing data received at the surface from the BHA 155 (e.g., as part of an inversion to obtain one or more desired formation parameters), and from the other sensors described above associated with the drilling and measurement system. The surface logging, recording and control system 152 may include one or more computer systems as will be explained with reference to FIG. 2. The other previously described sensors including the torque sensor 159, the pressure sensor 158, the hookload sensor 157 and the hook elevation sensor 161 may all be in signal communication, e.g., wirelessly or by electrical cable with the surface logging, recording and control system 152. Measurements from the foregoing sensors and some of the sensors in the MWD and LWD modules may be used in various embodiments to be further explained below.

Figure 2:
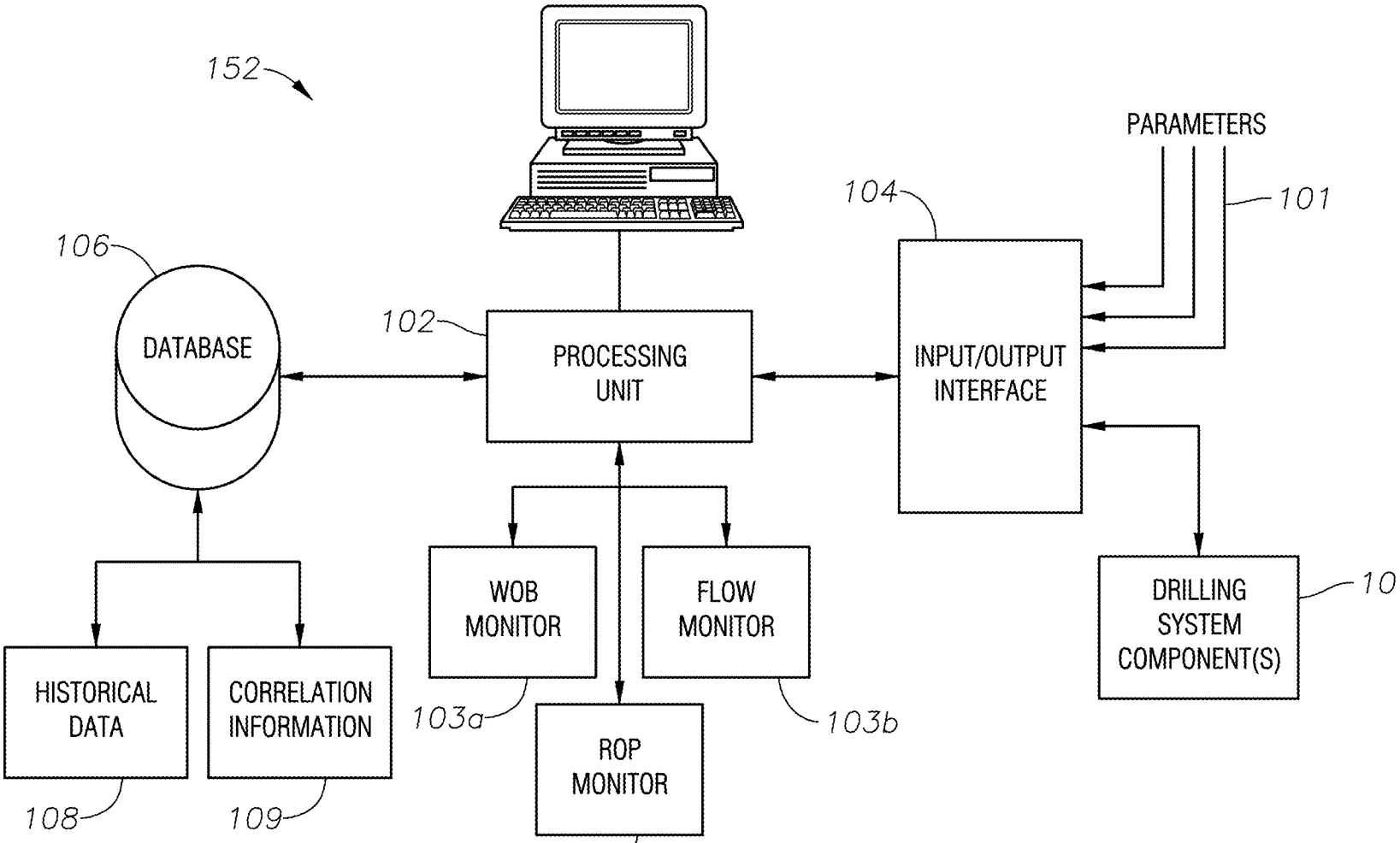
FIG. 2 is a detailed view of the logging and control system illustrated in FIG. 1, according to one or more example embodiments.

The control system 152 is schematically shown in FIG. 2. As briefly depicted, the control system 152 includes a processing unit 102, which can be part of a computer system, a server, a programmable logic controller, etc. The processing unit 102 has a number of monitors or controls 103*a-b* used for monitoring or control during drilling operations. As shown herein, the processing unit 102 operates a monitor 103*a* for weight-on-bit, a monitor 103*b* for flow, and a monitor 103*c* for ROP to name a few.

Using input/output interfaces 104, the processing unit 102 can communicate with various components of the drilling system shown in FIG. 1 to obtain information on parameters and to communicate with various sensors, actuators, and logic control for the various system components as the case may be. In terms of the current controls discussed, signals communicated to the drilling system's components can be related to controls for altering the rate of penetration of the drilling system in the drilling operation. The signals can include, but are not limited to, signals to control the flow rate, weight on bit, hookload, RPM, rotary torque, etc.

The processing unit 102 also communicatively couples to a database or storage 106 having historical data 108, correlation information 109, and other stored information. The historical data 108 characterizes the cuttings concentrations, ROP, etc. with stuck pipe incidents based on previous drilling operations. The correlation information 109 is compiled from the historical data based on the analysis disclosed herein and can be organized and characterized based on borehole types, borehole depths, drilling fluids, operating conditions, and other scenarios and arrangements.

Before going into further details of the drilling system, the control system 152, and the drilling process, discussion first turns to how a maximum "safe" rate of penetration is determined based on a concentration of cuttings at or near the bottom hole assembly 151 (e.g., drill tool or bit 155). In terms of the present disclosure, the concentration of cuttings can be determined at the drill bit or at least near the drill bit (i.e., around the area of the bottom hole assembly 151 having the drill bit 155). As is customary, the bottom hole assembly 151 of a drilling system typically has a drill tool or bit 155 and can have a number of other components, such as stabilizers, drill collars, measurement while drilling (MWD) instruments, rotary steerable tool, and the like. The overall size and length of the bottom hole assembly depends on a number of factors, such as desired weight on bit, weight of the drill collar, mud weight, buoyancy, etc.

Based on a mass balance for cuttings entering the flow stream and the ability to remove them, the control system 152 can calculate a cuttings concentration at the bit face and the near-bit area at any given time for both historical and real-time data. This is termed cuttings concentration $f_c$. In particular, the control system 152 stores information that is based on historical data sets and that correlates calculated cuttings concentration $f_c$ versus depth for on-bottom drilling where problems such as stuck pipe occurred. The stored information establishes an empirical "safe" or "acceptable" cuttings concentration $f_c$ for drilling under various drilling parameters. The "safe" cuttings concentration $f_c$ may vary based on the inclination of the borehole, type of BHA, formation properties or type (e.g. shale, limestone, etc.), mud weight, current drilling operation (connection, pump sweep, rotary drilling, etc.) and other factors.

The control system 152 obtains relevant drilling data in real-time while drilling from an available data stream, such as available in Wellsite Information Transfer Specification (WITS) or Wellsite Information Transfer Standard Markup Language (WITSML) data streams. The relevant drilling data can be supplemented with various user inputs, such as mud weight and the like. The control system 152 may also use log data.

Using the stored information and the real-time data, the control system 152 can calculate a "safe" or "acceptable" cuttings concentration $f_c$ for drilling, which in turn can provide a maximum "safe" ROP at any given time or depth. Equations used by the control system 152 for calculating the "safe" cuttings concentration $f_c$ and maximum "safe" ROP for drilling will now be discussed.

Figure 3:
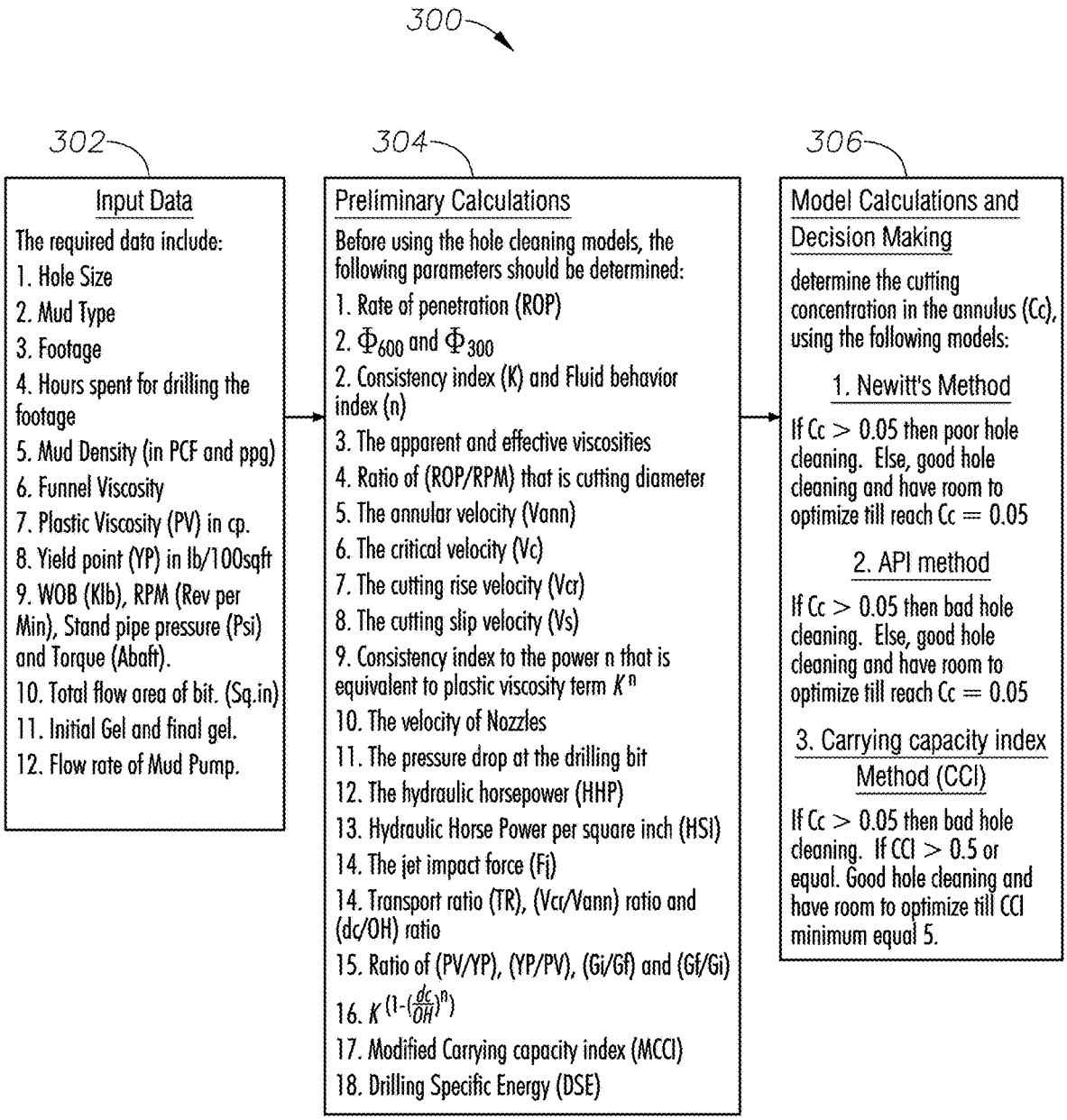
FIG. 3 is a block diagram illustrating a method for optimizing rate of penetration in a drilling operation, according to one or more example embodiments.

FIG. 3 is a block diagram illustrating a method 300 for optimizing rate of penetration in a drilling operation, according to one or more example embodiments. As illustrated in this block diagram, the system receives input data 302 and performs preliminary calculations 304. Based on the preliminary calculations 304, the system performs model calculations 306 to make decisions and control the drilling operations. The input data 302 may include one or more input parameters including, for example, hole size, mud type, footage, hours spent for drilling the footage, mud density in pounds per cubic feet (pcf) and pounds per gallon (ppg), funnel viscosity, plastic viscosity (PV) in centipoise (cp), yield point (YP) in lb/100 sqft, weight of blend (WOB) in Klb, revolutions per minute (RPM), stand pipe pressure in psi, torque in lbf·ft, total flow area of the bit in square inches, initial gel and final gel types, and flow rate of the mud pump. Before using the hole cleaning models, however, a plurality of output parameters are determined by the system using the input parameters provided in the input data 302. These output parameters include rate of penetration (ROP), consistency index (K), fluid behavior index (n), $\Phi_{600}$ and $\Phi_{300}$, apparent and effective viscosities, cutting diameter (i.e. ROP/RPM), annular velocity ($V_{ann}$), critical velocity ($V_c$), cutting rise velocity ($V_{cr}$), cutting slip velocity ($V_s$), consistency index to the power n ($K^n$), velocity of nozzles, pressure drop at the drilling bit, hydraulic horsepower (HHP), hydraulic horse power per square inch (HSI), jet impact force ($F_j$), transport ration (TR), $V_{cr}/V_{ann}$ ratio and dc/OH ratio, PV/YP, YP/PV, $G_t/G_f$, $G_f/G_t$, $K^{(1-(dc/OH)[<]}$ BEGINITALmn), modified carrying capacity index (MCCI), and drilling specific energy (DSE). After the plurality of output parameters are calculated, the system may perform model calculations 306 for decision making. More specifically, the system may use one of three or more methods to determine the cutting concentration in the annulus (CCA). The methods may include Newitt's method where the system determines that if the CCA is greater than 0.05, then it is considered poor hole cleaning. Else, the system may consider it good hole cleaning and have room to optimize till the CCA value equals 0.05. The next method is API method, where if the system determines that the CCA is greater than 0.05, then it is considered bad hole cleaning. Else, the system may consider it a good hole cleaning and have room to optimize till the CCA value equals 0.05. The next method is carrying capacity index (CCI) method, where if the system determines that the CCI is less than 0.5, then it is considered a bad hole cleaning. Else, the system may consider it a good hole cleaning and have room for optimizing till the CCI value equals 0.5.

Cutting concentration in the annulus is an effective tool that can indicate what percentage of cuttings generated while drilling are loaded in the annulus. The cutting concentration in annulus has a limit that is not supposed to be exceeded. For example, in some instances the limit of the CCA is within the range of 5% to 8%. If the CCA exceeds this limit, it can strongly lead to severe hole problems. There are several logical reasons that can explain why exceeding the limit can induce hole problems. CCA can help in optimizing the rate of penetration since the limit is known and recognized. The input parameters to determining CCA are rate of penetration (ROP), hole size (OH), flow rate of mud pump (GPM), and transport ratio (TR). CCA can be calculated using the following formula:

$$CCA = \frac{ROP\ \mathrm{OH}^2}{1472\ GPM\ TR}$$

In some cases, the size of cuttings, size of annulus, flow pattern, and down hole fluid properties cannot be determined with high degree of accuracy. CCI is a simple empirical index to help predict hole cleaning. The product of the three most important and influential variables on the transport ratio (TR) is equal to a value around 400,000 where cuttings are properly lifted to the surface. Good hole cleaning is indicated when the cuttings have sharp shape edges. Round edges indicate that there is tumbling action in the annulus because cuttings are not transported to surface quickly. The hole cleaning index or ratio is expected to be 1 or greater than 1 for good hole cleaning condition. When a CCI value is 0.5 or less, the cuttings are more rounded and small due to inefficient hole cleaning (longer residence time in annulus). Good hole cleaning can be achieved by increasing the value of K (consistency index) and annular velocity. This CCI is applicable in vertical hole sections of inclination from 0 to 25 degrees. For deviated and horizontal hole section, CCI must be modified. Modified CCI is applicable for inclination greater than 25 degrees. In a vertical well, the formula for determining CCI may be given as follows:

MW=the mud weight in PPG,
$A_v$=Mud annular Velocity; ft/min
K=the consistency index, equivalent cp
$K=511^{(1-n)}$ (PV+YP),
PV=Plastic viscosity; cp
YP=yield point (lb/100 $ft^2$)
n=3.32 log ((2PV+YP)/(PV+YP))

$$CCI = \frac{\mathrm{MW\ K}\ Av}{400{,}000}$$

For a horizontal well, the angle factor (Af) comes into play, and CCI can be determined using the following formula:

$$CCI = \left(\frac{\mathrm{K}\ SG\ Af}{3585\ Aa}\right)$$

K: consistency index, equivalent cp
$K=511^{(1-n)}$ (PV+YP),
PV: Plastic viscosity;
YP: Yield point (lb/100 $ft^2$)
n=3.32 log((2PV+YP)/(PV+YP))
$A_a$: Annular Area; $ft^2$.
SG: Specific gravity.

CCA indicates the amount of cuttings generated by the measured ROP using sensor measurement so that one can make sure the amount of cuttings is smooth with measured ROP to enable one to know the target ROP that can be achieved without affecting the hole cleaning's smoothness. CCI ensures the perfect mud properties that will empower the drilling fluid capacity to transport the generated drilling cuttings. Hence one can ensure the generated drilling cuttings are smooth with measured ROP and one can optimize it to targeted ROP.

Mechanical and drilling specific energy (MSE and DSE) generally indicate how efficient the drilling operation is. Specifically, DSE is the energy needed for removing a unit volume of rock. To obtain excellent performance of drilling, mechanical specific energy is decreased in order to have optimum drilling rate. To minimize MSE or DSE the drilling parameters such as WOB, Torque, ROP and RPM must be controlled. MSE is a ratio, and demonstrates the relationship among the required energy to destroy the rock and rate of penetration. The ratio is constant for a given rock. DSE or MSE is utilized to elect the required WOB and RPM that can increase the drilling rate till the point that ROP starts to deviate from linearity to flounder point and that indicate more hole cleaning efficiency is required to be achieved. The input parameters for determining DSE are WOB, RPM, Torque, ROP, Bit diameters or hole size and hydraulic horsepower of bit (HHP). DSE or MSE can be measured by the sensor of the rig or calculated using the following formula:

$$DSE = \frac{4\ WOB}{nD_B^2} + \frac{480\ RPM\ TRQ}{D_B^2\ ROP} - \frac{3{,}189{,}335\ HHP_B}{D_B^*\ ROP}$$

The ratio of cuttings or slip velocity to annular velocity is called the transport ratio (TR) and it can be used to describe hole cleaning efficiency. Anything that increases the transport ratio, will increase hole cleaning efficiency in vertical and directional wells. A reduction in slip velocity is one way that the transport ratio can be increased. The slip velocity is influenced by the size, density and shape of drilling cuttings, and rheology, density and velocity of mud.

The larger and heavier the cutting, and the lighter and less viscous the fluid, the faster the cutting will slip through the mud. Much of work and studies done in vertical wells were to improve hole cleaning efficiency and is aimed to reduce the slip velocity or increasing the annular velocity. Some initiatives have proposed equations to estimate slip velocity while drilling operations. However, these equations are needed to give precise values in such a complex flow behavior. Optimum flow rate and drilling fluid parameters have important effect on the hole cleaning since generated drilling cuttings can be removed by applying critical velocity and critical flow rate as well. The annular velocity which allows fluid in annuli loaded with cuttings to travel up to the surface is a very critical hole cleaning key. As a rule of thumb of some drilling fluid engineers, the annular velocity of drilling mud should be 1.2 times more than the settling velocity to ensure minimum cuttings movement in annulus. The size, shape, and weight of generated drilling cuttings lead to controlling its rate of slipping through circulating drilling fluid. Low rate of shear of viscosity can significantly affect the capability of carrying of mud in the well bore. Drilling mud must have adequate capability of carrying to transport generated drilling cuttings from the wellbore.

Hole cleaning ratio (HCR) is the ratio of the height of annular space above the cuttings beds to the critical height of the cuttings bed. if the height of free region above the cuttings bed is greater than the critical bed height, the more pulling through of cuttings bed without circulating. If ratio is greater than one, there will be no problem. If the ratio is less than one then, problems will be expected. From a study of 50 larger diameter directional wells in North Sea, when the HCR was greater than 1.1, no stuck pipe incidents occurred. When the HCR was less than 0.5, stuck pipe always occurred. As the HCR decreases, the tendency to become stuck increases. As bed height increases, the annular space above the cuttings bed decreases. The larger the BHA (Bottom Hole Assembly), the smaller the cuttings bed must be to pull through it. In general, over pull tend will increase as the BHA diameter increases. The drill string, bit and stabilizer selection should take these factors into account.

The effect of the mud weight (MW) is combined together with the rheology factor (RF) and angle factor (Af) to form a single parameter called the Transport Index (TI). Transport index must be greater than one. The larger transport index, the more the hole cleaning efficiency. It indicates the minimum flow rate required for each section even if the washout has been induced. Where MW is in SG (specific gravity) or g/cc. High inclination of hole section means low value of the angle factor value, hence, the difficulty of hole cleaning will be more. The rheology factor (RF) has been found by using PV & YP and the relationship between RF and PV & YP indicates effective hole cleaning.

Figure 4:
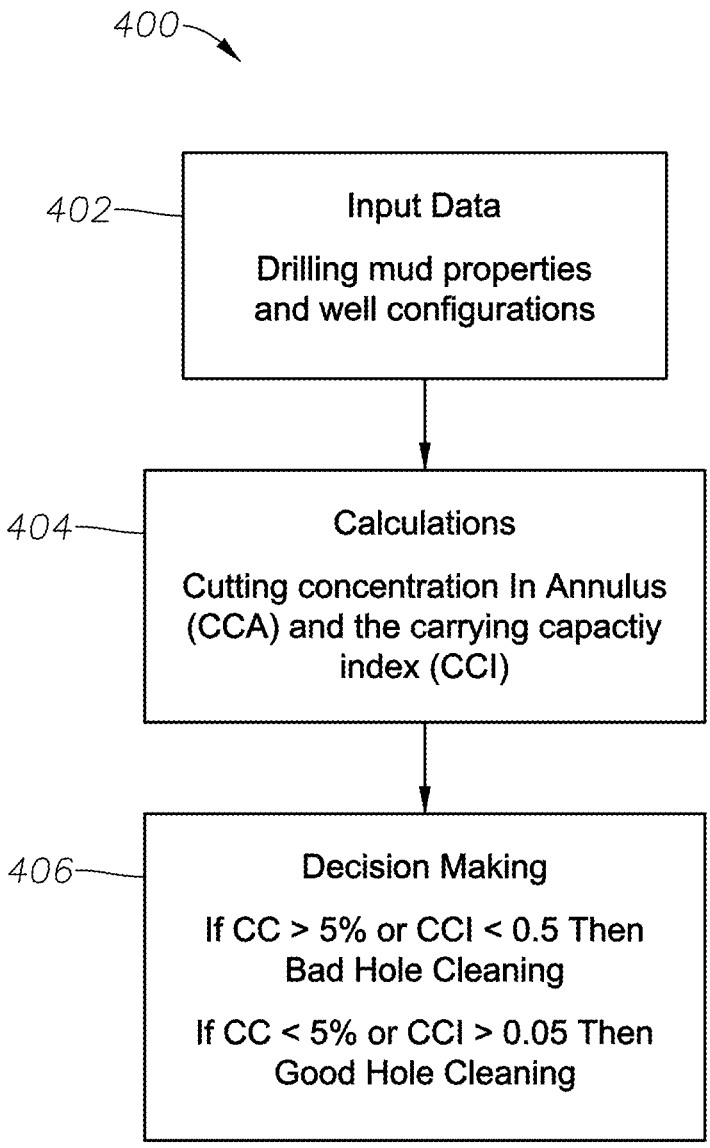
FIG. 4 is a flow diagram illustrating example steps in a method for optimizing rate of penetration in a drilling operation, according to one or more example embodiments.

FIG. 4 is a flow diagram illustrating example steps in a further method 400 for optimizing rate of penetration in a drilling operation, according to one or more example embodiments. In this method, the system, for example, receives input data in step 402, performs calculations in step 404, and makes decisions in step 406. The input data may include, among other things, drilling mud properties and well configurations as those listed in FIG. 3, for example. The calculations may include, among other things, determining the cutting concentration in annulus (CCA) and carrying capacity index (CCI). The decision making is similar to that shown in FIG. 3, where if the CCA is greater than 5% or CCI is less than 0.5, then it is considered a bad hole cleaning, and if the CCA is less than 5% or CCI is greater than 0.5, then it is considered a good hole cleaning.

Figure 5:
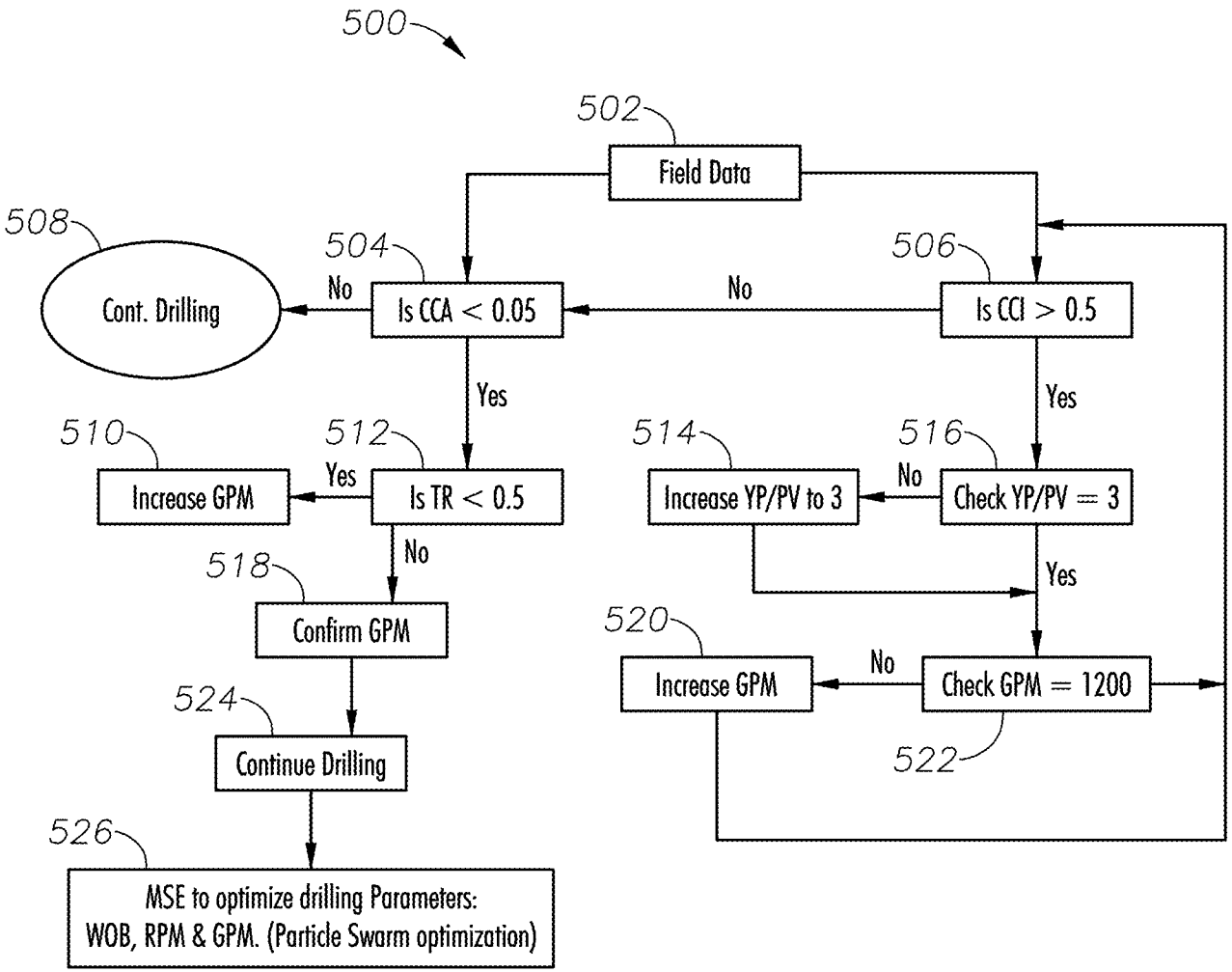
FIG. 5 is a flow diagram illustrating example steps in a method for optimizing rate of penetration in a drilling operation, according to one or more example embodiments.

FIG. 5 is a flow diagram illustrating example steps in a further method 500 for optimizing rate of penetration in a drilling operation, according to one or more example embodiments. In this method, the system receives field data in step 502. The field data may include input data, such as that shown in FIG. 3, for example. Upon receiving the field data, the system initially determines values for CCA and CCI. If the system determines that the CCA value is greater than or equal to 5% in step 504, then it instructs the logging and control system to continue drilling. Similarly, if the CCI is less than or equal to 0.5 in step 506, then it instructs the logging and control system to continue drilling. However, if the CCA value is less than 5% in step 504, then the system checks the TR value in step 512, and if the TR value is less than 0.5, then the system increases GPM in step 510 till CCA is equal to 5%. But if TR value is not less than 0.5, then the system confirms GPM in step 518 and continues the drilling operation in step 524. At step 526 of the process, the system optimizes drilling parameters including WOB, RPM and GPM, which process is also called as 'particle swarm optimization.' In alternate embodiment, if the CCI value is greater than 0.5, then the system checks for the YP/PV value in step 516. If YP/PV is not equal to 3, then the system increases YP/PV value to 3 in step 514. However, if the YP/PV value is equal to 3 in step 516, then the system checks for the GPM value in step 522. If the GPM value is equal to 1200, then the system returns to step 506 to check for the value of CCI. However, if the GPM is not equal to 1200, then the system increases GPM in step 520 until it reaches a 1200 value.

Particle swarm optimization (PSO) can be defined as computational method to enhance a given problem by performing many trials and tests to optimize a proposed solution that is relevant with a special measure of quality. The optimization process of PSO begins to have a huge number of proposed solutions that called particles, and then having these particles searched based one preferable and simple mathematical law for position of particles and velocity. The movement of proposed solution are caused through the local best-known position. Then aimed toward best matching position in search space and finally enables movement of the swarm direct to the best proposed solutions. PSO is basically attributed to Kennedy, Eberhart and Shi, (Kennedy, 1995) and (Shi, 1998), and was first intended for estimating the behavior of society, (Kennedy, 2001), as a representative style of the movement of organisms in a flock of bird or school of fish. The algorithm was simplified and it was noticed to be doing enhancement. The book by Kennedy and Eberhart, (Kennedy, 1997), describes many aspect of philosophy of PSO and intelligence of swarm. An extensive survey of application of PSO is done by Poli, (Poli, 2007) and (Poli, 2008). PSO can do a few or no assumptions about the problem that is being enhanced and makes very large spaces of proposed solutions. However, PSO cannot ensure an exact solution is ever found. Especially, PSO does not use the gradient of the problem which is being optimized, that means PSO does not ask for the enhancement of problem to be different as is required by classic optimization methods such as gradient descent and quasi-newton methods. PSO makes also the use of optimization of problems that are partially irregular, noisy, change over time, etc.

FIG. 6 is a table 600 showing test results obtained using a method for optimizing rate of penetration in a drilling operation, according to one or more example embodiments. As it can be seen from this table, there is significant improvement in ROP, HHPb, CCI, Vann, and YP/PV value using the methods and systems of the present disclosure. Similarly, DSE can be minimized up to 64% using the methods and systems of the present disclosure.

FIG. 7 is a another table 700 showing test results obtained via model trials performed in two wells using a method for optimizing rate of penetration in a drilling operation, according to one or more example embodiments. Similar to the results shown in FIG. 6, it can be seen from this table that there is significant improvement in ROP, HHPb, CCI, Vann, and YP/PV value using the methods and systems of the present disclosure. Additionally, DSE can be minimized up to 50% using the methods and systems of the present disclosure.

Figure 8A:
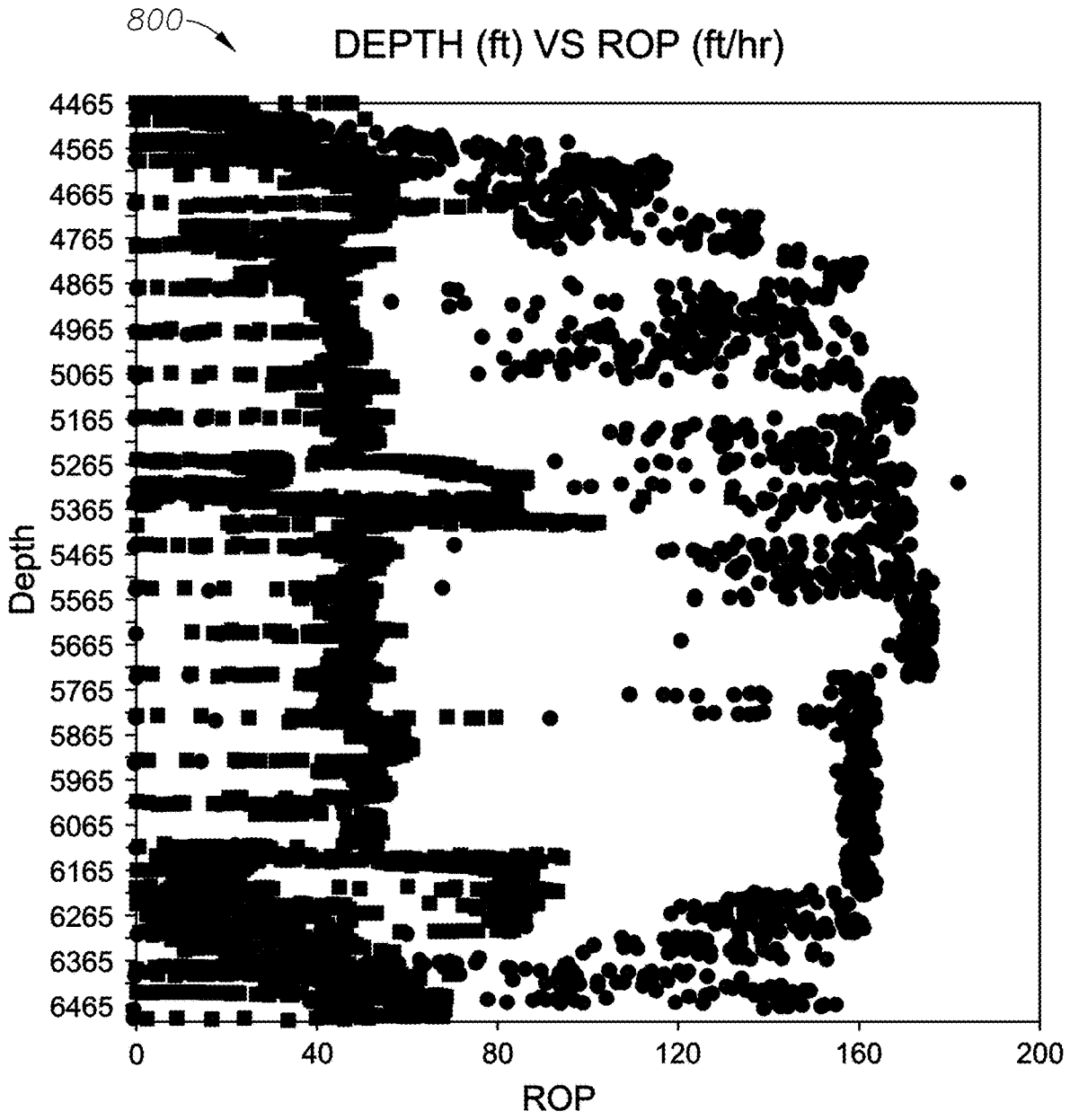
FIG. 8A is a graph plotting depth in feet versus rate of penetration in feet per hour prior to applying an optimization model, according to one or more example embodiments.
Figure 8B:
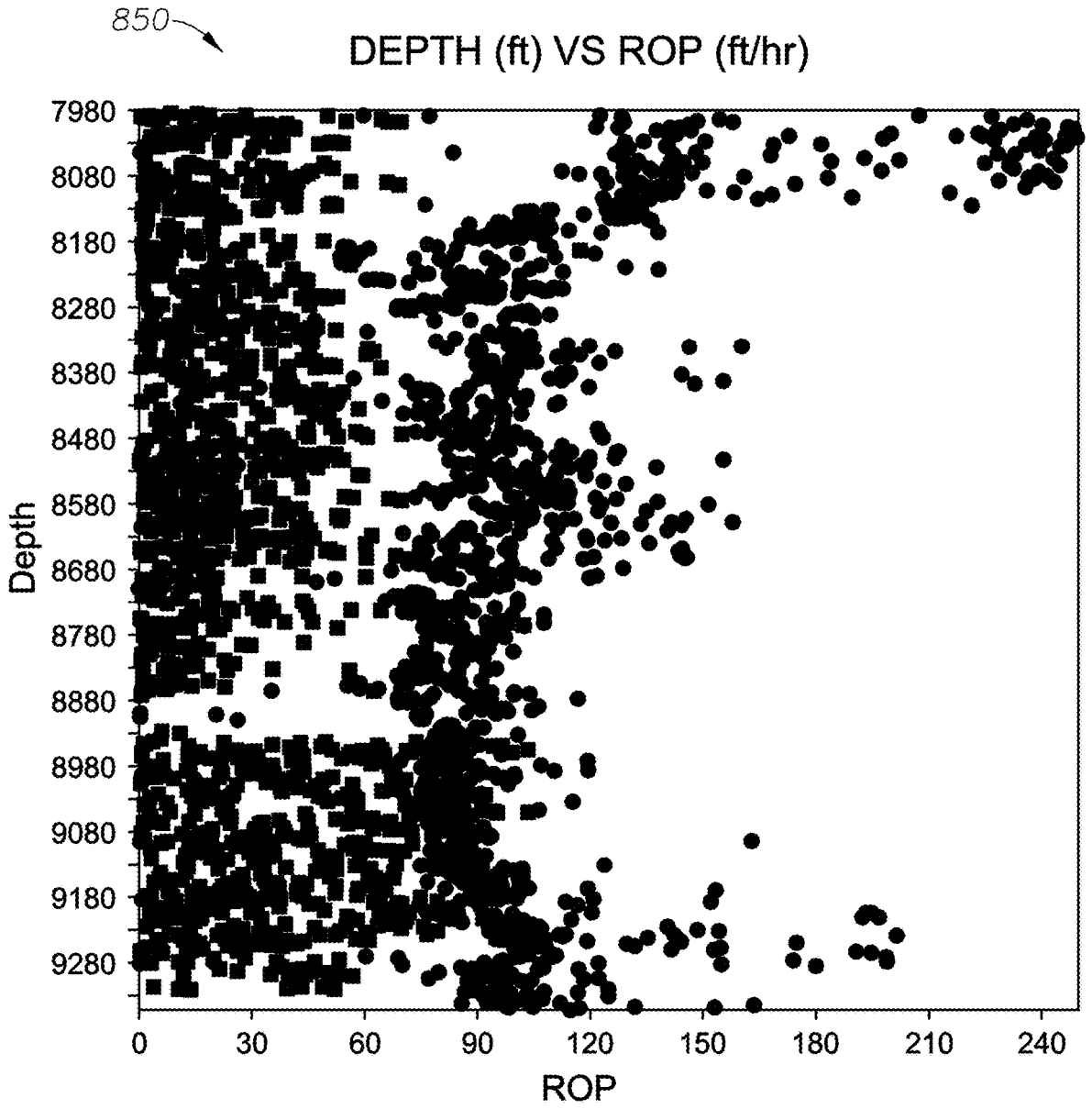
FIG. 8B is a graph plotting depth in feet versus rate of penetration in feet per hour after applying an optimization model, according to one or more example embodiments.

FIG. 8A illustrates a graph 800 plotting depth of the borehole in feet versus rate of penetration in feet per hour prior to applying an optimization model, according to one or more example embodiments. The orange dots represent the actual ROP and the blue dots represent the measured ROP. FIG. 8B illustrates a graph 850 plotting depth of the borehole in feet versus rate of penetration in feet per hour after applying an optimization model, according to one or more example embodiments. The orange dots represent the actual ROP and the blue dots represent the measured ROP. As it can be seen from this graph there is significant improvement in ROP, using the optimization methods and systems of the present disclosure.

Figure 9A:
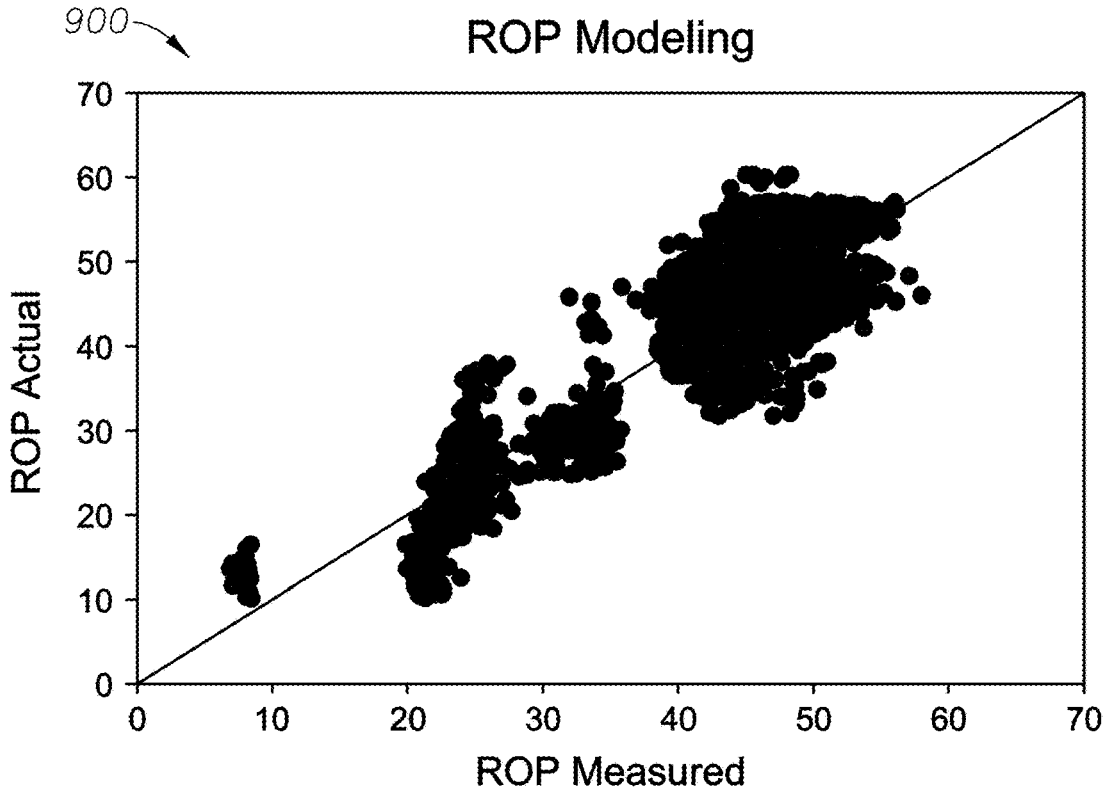
FIG. 9A is a graph plotting actual rate of penetration in feet per hour versus measured rate of penetration in feet per hour prior to applying an optimization model, according to one or more example embodiments.
Figure 9B:
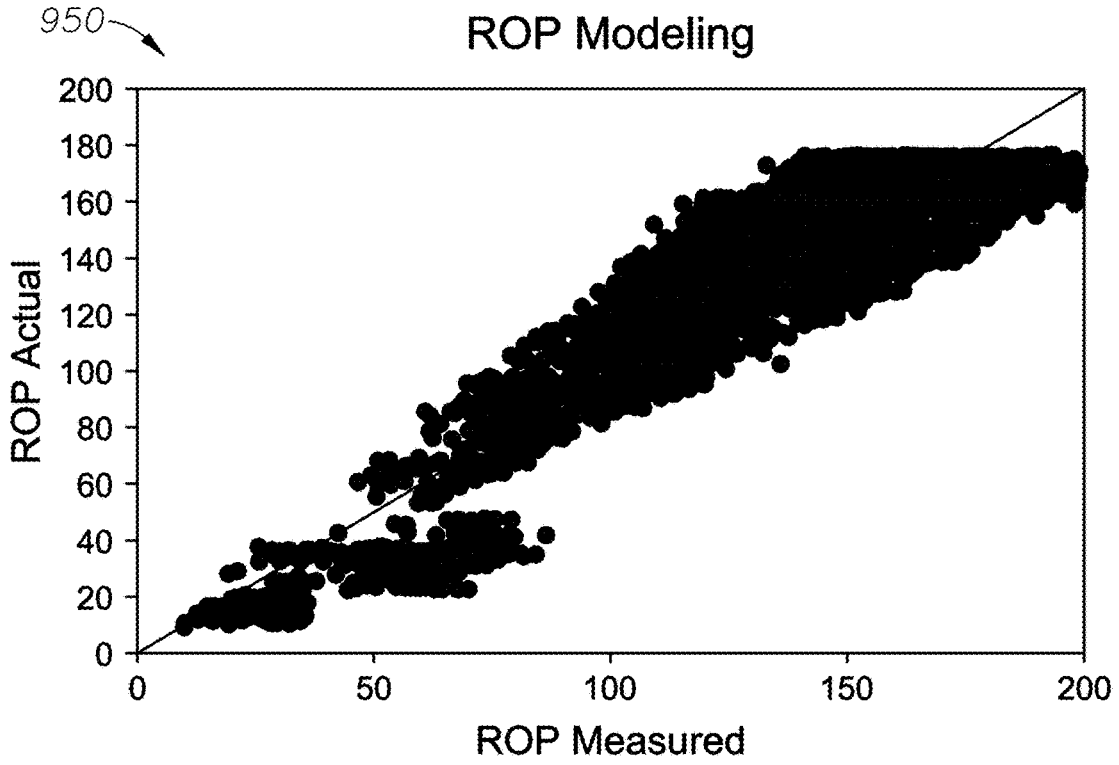
FIG. 9B is a graph plotting actual rate of penetration in feet per hour versus measured rate of penetration in feet per hour after applying an optimization model, according to one or more example embodiments.

Similarly, FIG. 9A illustrates a graph 900 plotting actual rate of penetration in feet per hour versus measured rate of penetration in feet per hour prior to applying an optimization model, according to one or more example embodiments. FIG. 9B illustrates a graph 950 plotting actual rate of penetration in feet per hour versus measured rate of penetration in feet per hour after applying an optimization model, according to one or more example embodiments. As it can be seen from this graph the actual ROP appears to be in line with the measured ROP, using the optimization methods and systems of the present disclosure.

Figure 10A:
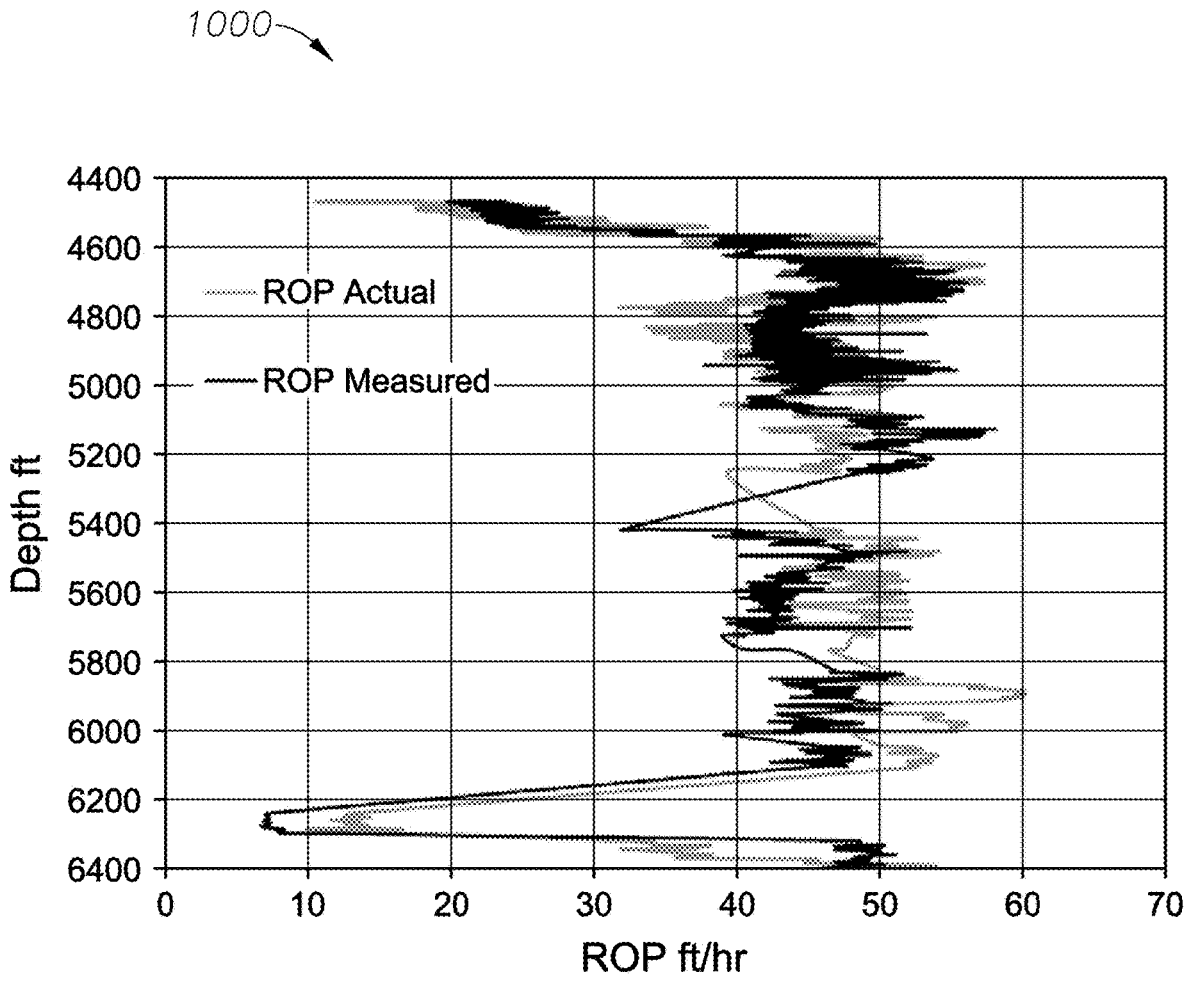
FIG. 10A is a line graph plotting depth in feet versus actual rate of penetration in feet per hour and measured rate of penetration in feet per hour prior to applying an optimization model, according to one or more example embodiments.
Figure 10B:
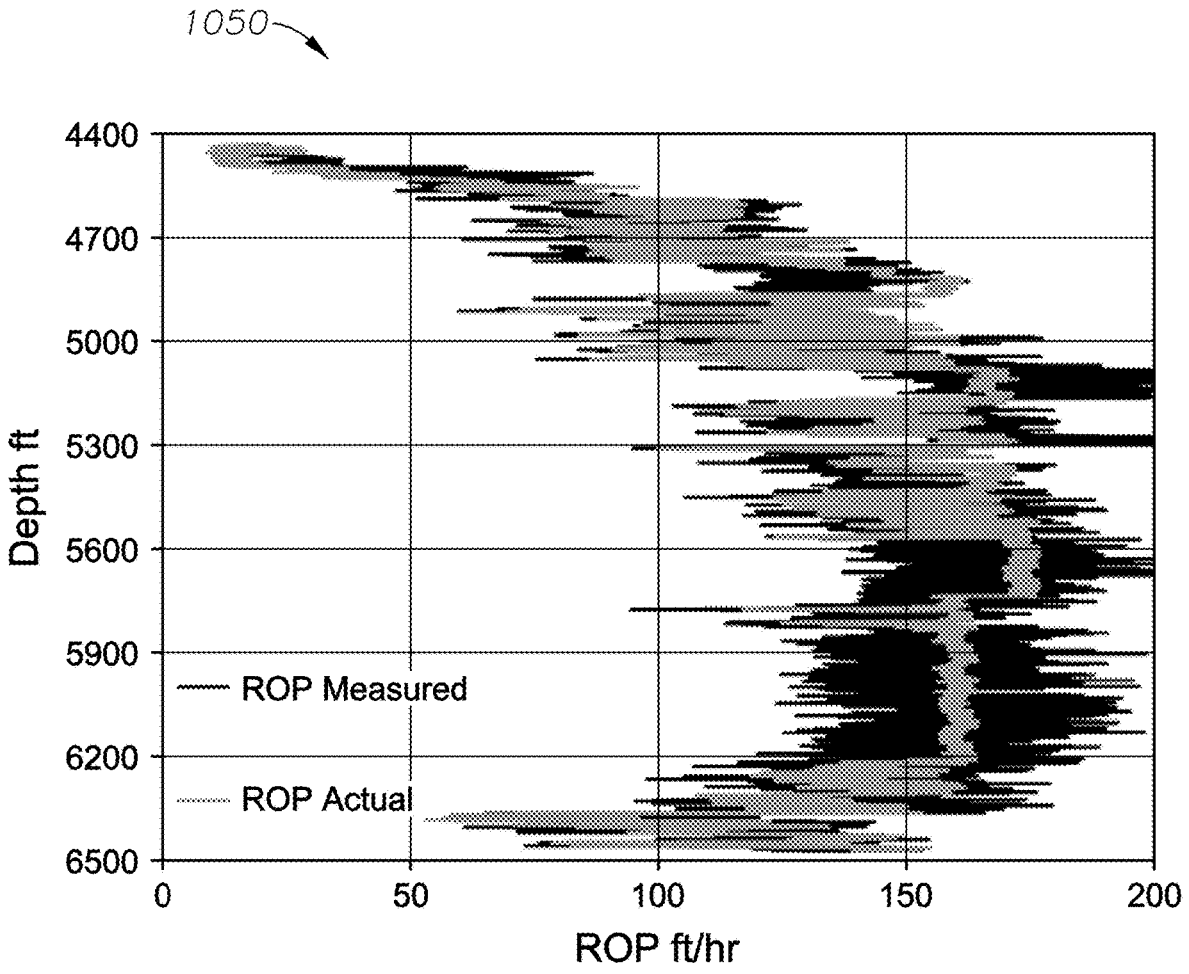
FIG. 10B is a line graph plotting depth in feet versus actual rate of penetration in feet per hour and measured rate of penetration in feet per hour after applying an optimization model, according to one or more example embodiments.

FIG. 10A is a line graph 1000 plotting depth in feet versus actual rate of penetration (orange line) in feet per hour and measured rate of penetration (blue line) in feet per hour prior to applying an optimization model, according to one or more example embodiments. FIG. 10B is another line graph 1050 plotting depth in feet versus actual rate of penetration (orange line) in feet per hour and measured rate of penetration (blue line) in feet per hour after applying an optimization model, according to one or more example embodiments. As it can be seen from this graph there is significant improvement in actual and measured ROP, using the optimization methods and systems of the present disclosure.

The data shown in FIGS. 8A-10B can be screened and filtered to capture only drilling properties and mud properties, and then they can be plotted against each other to identify the relationship between them. At later stage, the data and the resulting relationships can be used to develop a model that can help ensure hole cleaning efficiency and optimized drilling rate. The results may be used to develop efficient hole cleaning and optimized drilling rate to enhance the performance significantly. In addition, it can be used as a tool that can guide drilling engineers to efficient hole cleaning and drilling rate.

One objective of the above disclosed systems and methods is to ensure optimum mud rheology values that have effective influence on drilling mud from the aspects of ECD, cuttings transport, shear thinning, and thixotropic properties, including adding the optimum values for "n" and "K," the flow behavior index and consistency index, respectively, to develop an effective hole cleaning model by utilizing carrying capacity index and cutting concentration index in the annulus.

In some embodiment, by linking hole cleaning to drilling rate by using DSE to optimize the drilling parameters, this model can be run to prevent losses from occurring. It can also be used in conjunction with wellbore strengthening and lost circulation materials to enhance the efficiency of the mud system.

The systems and methods disclosed above are suitable for vertical hole sections. However, it can also be applied to deviated or horizontal hole sections as well. The systems and methods disclosed above can eliminate wiper trips, reaming trips, and pumping sweeps, increase ROP significantly, and prevent hole problems such as losses, tight spots and stuck pipe. Additionally, the systems and methods disclosed above can provide an optimized smart solution along with drilling operations to avoid the most chronic challenging hole problems encountered while drilling e.g. pipe sticking, loss circulation, and hole cleaning.

The above described systems and methods may be applied to any deviated and/or horizontal sections. They may also be used in conjunction with RTOC to ensure optimum performance is reflected in all other rigs. According to some embodiments, the systems and methods disclosed above can be applied any drilling activity suffering from losses, stuck pipe, well bore stability, hole cleaning, slow drilling rate, lack of optimization, and longer than usual non-productive time. The advantages of the above disclosed systems and methods include elimination of wiper trips, elimination of reaming trips, elimination of pumping sweeps, increase in ROP significantly, and prevention of hole problems like losses, tight spots, and stuck pipes. The technical solution provided by the systems and methods disclosed above include ensuring optimum mud rheology and bit hydraulics, developing effective hole cleaning model by utilizing carrying capacity index and cutting concentration index in annulus, linking hole cleaning to drilling rate, improving drilling rate, and optimizing the drilling parameters.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed herein and the scope of the appended claims.

The invention claimed is:

1. A method of drilling a borehole with a drill tool of a drilling system that uses drilling mud to transport cuttings of a formation to surface, the method comprising:

receiving a plurality of input parameters of a drilling operation conducted with the drilling system, the input parameters at least including a cuttings parameter related to the cuttings produced in the drilling operation;

determining a current concentration of the cuttings in annulus (CCA) near the drill tool based on the input parameters;

determining a desired rate of penetration for the drilling operation based on the determined cuttings concentration in annulus (CCA); and altering a current rate of penetration based on the determined desired rate, wherein CCA is determined used a formula:

$$CCA = \frac{ROP\ \mathrm{OH}^2}{1472\ GPM\ TR}$$

wherein ROP is the current rate of penetration, OH is the hole size, GPM is the flow rate of mud pump, and TR is the transport ratio.

2. The method of claim 1, further comprising:

determining a carrying capacity index (CCI) based on the plurality of input parameters;

determining a second desired rate of penetration for the drilling operation based on the determined cutting concentration in annulus (CCA) and the carrying capacity index (CCI); and altering the current rate of penetration based on the determined second desired rate.

3. The method of claim 2, wherein CCI in a vertical well is determined using a formula:

$$CCI = \frac{\mathrm{MW\,K}\ Av}{400{,}000}$$

where MW is the mud weight, K is the consistency index, and $A_v$, if the mud annular velocity.

4. The method of claim 2, wherein CCI in a deviated or horizontal well is determined using a formula:

$$CCI = \left(\frac{\mathrm{K}\,SG\ Af}{3585\ Aa}\right)$$

where K is the consistency index, SG is the specific gravity, $A_f$ is the angle factor of the deviated or horizontal well, and $A_a$ is the annular area.

5. The method of claim 1, wherein receiving the input parameters comprises obtaining one or more of: a weight of the drilling mud (MW), flow rate of the drilling mud (GPM), the current rate of penetration (ROP) of the drilling system, a depth of the borehole, a depth of the drill tool of the drilling system, a density of the cuttings, a diameter of the cuttings, an eccentricity factor of the borehole, and a porosity of the formation.

6. The method claim 1, wherein determining the current concentration of the cuttings in the annulus (CCA) near the drill tool based on the input parameters comprises using a volumetric flow rate of the drilling mud, a volumetric flow rate of the cuttings, and a relationship between slip velocity and axial velocity in the determination.

7. The method of claim 6, wherein determining the current concentration of the cuttings in the annulus (CCA) near the drill tool based on the input parameters further comprises using in the determination one or more of:

an area of an annulus near the drill tool, an eccentricity of the borehole, a surface area of the drill tool of the drilling system, and a porosity of the formation.

8. The method of claim 1, wherein the input parameters further comprise hole size (OH), measured rate of penetration (ROP), transport ratio (TR), mud type, footage, hours spent for drilling the footage, mud density in pounds per cubic feet (pcf) and pounds per gallon (ppg), funnel viscosity, plastic viscosity (PV) in centipoise (cp), yield point (YP) in lb/100 sqft, weight of blend (WOB) in Klb, revolutions per minute (RPM), stand pipe pressure in psi, torque in lbf.ft, total flow area of the bit in square inches, initial gel and final gel types, and flow rate of the mud pump (GPM).

9. The method of claim 8, further comprising:

determining the transport ratio (TR) is less than a predetermined threshold value;

altering the flow rate of mud pump (GPM) in order to increase the current concentration of the cuttings in the annulus (CCA) to above 5%.

10. The method of claim 8, further comprising:

determining that a ratio of yield point versus plastic velocity (YP/PV) is less than a predetermined threshold value;

altering the YP/PV in order to reach a YP/PV value of at least 3.

11. The method of claim 10, further comprising:

determining the flow rate of mud pump (GPM) is less than a predetermined threshold value;

altering the GPM in order to reach a GPM value of at least 1200.

12. The method of claim 1, further comprising:

determining drilling specific energy (DSE) using a formula:

$$DSE = \frac{4\ WOB}{nD_B^2} + \frac{480\ RPM\ TRQ}{D_B^2\ ROP} - \frac{3{,}189{,}335\ HHP_B}{D_B^2\ ROP}$$

where WOB is the weight of blend, RPM is the revolutions per minute, TRQ is the torque, $HHP_B$ is the hydraulic horsepower of the bit, $D_B$ is the diameter of the bit, and ROP is the measured rate of penetration.

13. A program storage device having program instructions stored thereon for causing a programmable control device to perform the method of drilling the borehole according to claim 1.

14. A drilling system for drilling a borehole with a drill tool using drilling mud to transport cuttings of a formation to surface, the system comprising:

storage configured to store historical information;

an interface obtaining a plurality of parameters of a drilling operation conducted with the drilling system, the input parameters at least including a cuttings parameter related to the cuttings produced in the drilling operation; and a processing unit in communication with the storage and the interface and configured to:

receive the plurality of input parameters;

determine a current concentration of the cuttings in annulus (CCA) near the drill tool based on the input parameters;

determine a desired rate of penetration for the drilling operation based on the determined cuttings concentration in annulus (CCA); and alter a current rate of penetration based on the determined desired rate, wherein CCA is determined used a formula:

$$CCA = \frac{ROP\ \mathrm{OH}^2}{1472\ GPM\ TR}$$

wherein ROP is the current rate of penetration, OH is the hole size, GPM is the flow rate of mud pump, and TR is the transport ratio.

15. The system of claim 14, wherein the processing unit is further configured to:

determine a carrying capacity index (CCI) based on the plurality of input parameters;

determine a second desired rate of penetration for the drilling operation based on the determined cutting concentration in annulus (CCA) and the carrying capacity index (CCI); and alter a current rate of penetration based on the determined second desired rate.

16. The system of claim 14, wherein obtaining the input parameters comprises obtaining one or more of: a weight of the drilling mud (MW), flow rate of the drilling mud (GPM), the current rate of penetration (ROP) of the drilling system, a depth of the borehole, a depth of the drill tool of the drilling system, a density of the cuttings, a diameter of the cuttings, an eccentricity factor of the borehole, and a porosity of the formation.

17. The system of claim 14, wherein determining the current concentration of the cuttings in the annulus (CCA) near the drill tool based on the input parameters comprises using a volumetric flow rate of the drilling mud, a volumetric flow rate of the cuttings, and a relationship between slip velocity and axial velocity in the determination.

18. The system of claim 17, wherein determining the current concentration of the cuttings in the annulus (CCA) near the drill tool based on the input parameters further comprises using in the determination one or more of:

an area of an annulus at least near the drill tool, an eccentricity of the borehole, a surface area of the drill tool of the drilling system, and a porosity of the formation.

19. The system of claim 14, wherein the input parameters further comprise hole size (OH), measured rate of penetration (ROP), transport ratio (TR), mud type, footage, hours spent for drilling the footage, mud density in pounds per cubic feet (pcf) and pounds per gallon (ppg), funnel viscosity, plastic viscosity (PV) in centipoise (cp), yield point (YP) in lb/100 sqft, weight of blend (WOB) in Klb, revolutions per minute (RPM), stand pipe pressure in psi, torque in lbf.ft, total flow area of the bit in square inches, initial gel and final gel types, and flow rate of the mud pump (GPM).

20. The system of claim 19, wherein the processing unit is further configured to:

determine the transport ratio (TR) is less than a predetermined threshold value;

alter the flow rate of mud pump (GPM) in order to increase the current concentration of the cuttings in annulus (CCA) to above 5%.

21. The system of claim 19, wherein the processing unit is further configured to:

determine that a ratio of yield point versus plastic velocity (YP/PV) is less than a predetermined threshold value;

alter the YP/PV in order to reach a YP/PV value of at least 3.

22. The system of claim 14, wherein CCI in a vertical well is determined using a formula:

$$CCI = \frac{\mathrm{MW\ K}\ Av}{400{,}000}$$

where MW is the mud weight, K is the consistency index, and $A_v$, if the mud annular velocity.

23. The system of claim 14, wherein CCI in a deviated or horizontal well is determined using a formula:

$$CCI = \left(\frac{\mathrm{K}\ SG\ Af}{3585\ Aa}\right)$$

where K is the consistency index, SG is the specific gravity, $A_f$ is the angle factor of the deviated or horizontal well, and $A_a$ is the annular area.

24. The system of claim 14, wherein the processing unit is further configured to:

determine drilling specific energy (DSE) using a formula:

$$DSE = \frac{4\ WOB}{nD_B^2} + \frac{480\ RPM\ TRQ}{D_B^2\ ROP} - \frac{3{,}189{,}335\ HHP_B}{D_B^2\ ROP}$$

where WOB is the weight of blend, RPM is the revolutions per minute, TRQ is the torque, $HHP_B$ is the hydraulic horsepower of the bit, $D_B$ is the diameter of the bit, and ROP is the measured rate of penetration.

* * * * *